US009202400B2

(12) United States Patent
Suciu et al.

(10) Patent No.: US 9,202,400 B2
(45) Date of Patent: Dec. 1, 2015

(54) FRAME TRIM EXTRUSION

(71) Applicants: Rebecca C. Suciu, Lynn, MA (US); Thomas P. Burrous, Haverhill, MA (US); Erik G. Zelbacher, Lynn, MA (US); Alan L. Stenfors, Scituate, MA (US); Sidney Rose, Marblehead, MA (US)

(72) Inventors: Rebecca C. Suciu, Lynn, MA (US); Thomas P. Burrous, Haverhill, MA (US); Erik G. Zelbacher, Lynn, MA (US); Alan L. Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 0 days.

(21) Appl. No.: 14/544,318

(22) Filed: Dec. 23, 2014

(65) Prior Publication Data

US 2015/0101227 A1 Apr. 16, 2015

Related U.S. Application Data

(63) Continuation-in-part of application No. 13/998,327, filed on Oct. 21, 2013, which is a continuation-in-part of application No. 13/986,248, filed on Apr. 15, 2013.

(51) Int. Cl.
*G09F 7/00* (2006.01)
*G09F 15/00* (2006.01)

(52) U.S. Cl.
CPC ..... *G09F 15/0012* (2013.01); *G09F 15/0025* (2013.01)

(58) Field of Classification Search
CPC .. G09F 15/0012; G09F 13/04; G09F 15/0068
USPC ..... 40/714, 780, 782, 734, 745, 752, 759, 40/761, 764
See application file for complete search history.

(56) References Cited

U.S. PATENT DOCUMENTS

| | | | | | |
|---|---|---|---|---|---|
| 3,302,351 | A * | 2/1967 | Trulaske | 52/309.1 |
| 4,428,135 | A * | 1/1984 | Sobel | 40/782 |
| 4,637,153 | A * | 1/1987 | Kane et al. | 40/605 |
| 4,805,324 | A * | 2/1989 | Andersson | 40/541 |
| 4,817,317 | A * | 4/1989 | Kovalak, Jr. | 40/603 |
| 4,870,769 | A * | 10/1989 | Ogilvie | 40/564 |
| 4,977,696 | A * | 12/1990 | Johansson | 40/605 |
| 5,911,525 | A * | 6/1999 | Jepsen et al. | 40/611.06 |
| 6,112,445 | A * | 9/2000 | Feeney | 40/747 |
| 6,782,649 | B1 * | 8/2004 | Adler | 40/734 |
| 8,220,190 | B2 * | 7/2012 | Walter | 40/611.06 |
| 8,365,449 | B2 * | 2/2013 | Gimpel et al. | 40/605 |
| 8,793,910 | B2 * | 8/2014 | Froio et al. | 40/606.17 |

* cited by examiner

*Primary Examiner* — Shin Kim
(74) *Attorney, Agent, or Firm* — Don Halgren

(57) ABSTRACT

An elongated rail member for end-wise attachment to a further elongated rail member for the manufacture of a two-sided flexible fabric display supporting quadrilateral-frame-assembly, each elongated rail member comprising an elongated outermost bridging member; an innermost elongated bridging member and an intermediate elongated bridging member each connected along their elongated edges by a first side member and a second side member resectively, including a graphic bead supporting slot arranged on each side of an elongated bridging member to enable simultaneous one or two sided display of a flexible graphic.

17 Claims, 15 Drawing Sheets

FRAME TRIM EXTRUSION

BACKGROUND OF THE INVENTION

Field of the Invention

This relates to edge-beaded display arrangements and more particularly to frame assemblies having constructional features which enable viewing of a plurality of edge beaded display panels from both sides of that frame assembly, and is a continuation in part application of application Ser. No. 13/998,327, filed Oct. 21, 2013, which is a continuation-in-part of application Ser. No. 13/986,248, filed Apr. 15, 2013, each of which is incorporated herein by reference.

Discussion of the Prior Art

There is a trend now in the graphic display industry to utilize flexible material such as fabrics and cloth, as opposed to more rigid, slide-in displays into a frame assembly as shown in our U.S. Pat. No. 8,627,589, incorporated herein by reference in its entirety.

Such beaded, flexible fabric material will usually permit the ease of manufacture, the change and the shipping of such displays. The periphery of these graphic displays may include a bead along their outermost edge. The outermost edge is seized in one way or another and the assembly held together by various attachments.

Such fabrics and displays have an early origin in fabric awnings and their assemblies. An example of such fabric awning assembly is shown in U.S. Pat. No. 5,044,131 to Fisher. Assembly and of course change of such fabric material however, is a bit of a challenge.

It is an object of the present invention to overcome the disadvantages of the prior art.

It is another object of the present invention to provide a frame arrangement which permits a beaded graphic display to be easily attached to and removed from that frame arrangement.

It is yet another object of the present invention to provide a frame arrangement which may be readily attached to a support member, either overhead, or on the frame arrangements side or the frame arrangements bottom with minimal assembly and minimal interruption of a smooth peripheral frame.

It is yet still another object of the present invention to provide a frame arrangement which will support a beaded graphic display from both a first side and a second side thereof, if that sort of display arrangement is desired.

Yet a further object of the present invention is to provide a frame arrangement which permits the graphic display to be presented with a frame face visible configuration or a graphic display with a frameless appearance.

BRIEF SUMMARY OF THE INVENTION

The present invention comprises a frame assembly consisting of a plurality of unitary rails joined at the respective mitered ends by corner connectors such as L shaped inserts, or by threaded bolts.

In a first preferred embodiment of the present invention as a "frame exposed" graphic display presentation, the frame assembly comprises a quadrilateral arrangement of elongated extruded rail members, the assembly of which preferrably requires mitered ends thereon.

Each rail member in a cross-sectional presentation thereof, is generally of U shaped configuration, defined by an intendedly outwardly disposed first or outer elongated bridging member having elongated, curved side edges which each extend into a first (shown for example here as tapered) thickness side member and a second (shown for example here as tapered) thickness side member respectively. The first and second side members extend to a first L-shaped portion and a second L-shaped portion respectively.

The first and second L-shaped portions are connected by an innermost elongated bridge member. The first and second L-shaped portions are also connected by an intermediate bridge member. The intermediate bridge member divides the elongated extruded rail member into a central channel and an intermediate, support hardware-head enclosing/capturing secondary channel.

The intermediate bridge member may have in one embodiment an elongated channel-shaped projection extending along the mid-location thereof interiorly into the central channel, or such projection may be tubular or solid in other embodiments. The projection may be defined by a pair of generally "L" shaped flanges with the assembly corner support hardware enclosing/capturing securement slot extending therebetween.

The innermost elongated bridge member, which extends between the first side L-shaped portion and the second L-shaped side portion of the unitary rail has a second side extending along and opposite to the secondary channel. An elongated single flange support extends longitudinally along the length of the elongated innermost bridge member. The single flange support has a distal edge which is attached, co-extrudedly, to an elongated innermost first graphic receiving slot flange and an elongated innermost second graphic receiving slot flange.

The space between the elongated inner most first graphic slot flange and second side of the innermost elongated bridge member as well as the space between the elongated innermost second graphics slot flange and the second side of the innermost elongated bridge member respectively define a first graphic bead slot receiving channel and a second graphic bead slot receiving channel respectively. Such graphic displays would extend generally in a plane, away from the first and second tapered side members towards a central portion of the frame assembly.

In a second preferred embodiment of the present invention as a "frame hidden" graphic display presentation, the frame assembly comprises a quadrilateral arrangement of elongated extruded rail members, the assembly of which requires mitered ends thereon.

Each rail member comprises an elongated, planar, outer facing member having an outer face and an inner surface. A first inner wall and a second inner wall, parallel to one another, extend longitudinally along the inner surface of the outer facing member. The first inner wall and the second inner wall define a narrow channel between them. The first inner wall and the second inner wall have a L-shaped lower end, opposed to one another, contiguously coextruded with a first inner slot defining wall and a second inner slot defining wall, respectively. The first inner slot defining wall and the second inner slot defining wall extend parallel with the outer facing member. First inner slot defining wall and the second inner slot defining wall each have an elongated distalmost edge comprising a graphic supporting shoulder.

A first side member and a second side member, parallel to one another, extend off of each respective graphic supporting shoulder of the first in a slot defining wall and the second inner slot defining wall, having a lower end with a first side L-shaped portion and a second side L-shaped portion respectively. An innermost elongated bridge member the first side L-shaped portion and the second L-shaped portion coextrudedly theretogether.

An intermediate bridging member extends between the first side member and the second side member along a generally midportion thereof, to define the rail member into a central channel and an inner channel. The inner channel may be utilized for accommodation to permit access to hardware recited hereinbelow. The intermediate bridging member has a first side with a shaped, for example, omega, corner securing member receiving slot arranged longitudinally therealong, as recited in the aforementioned embodiment.

The first inner slot and the second inner slot define elongated receiving portions for the beaded peripheral edge of a flexible graphic.

Thus, when a plurality of rail members are joined together by their respective ends, with a securement device either through an outer wall portion of one rail number or through an L-shaped securement arrangement with the respective slots it provides an aligned graphic beed securing means to fully and securely display a flexible graphic therewithin.

The invention thus comprises a multi-sided frame assembly for supporting and displaying a fabric display thereon, the frame assembly comprising: a plurality of elongated rail members connected at their respective ends by a securement arrangement therebetween, wherein each elongated rail member comprises an elongated outermost bridging member; an innermost elongated bridging member and an intermediate elongated bridging member each connected along their elongated edges by a first side member and a second side member respectively. An elongated chamber is disposed between the elongated intermediate bridge member and the elongated innermost bridge member to define a hardware-enclosing-channel for the enablement of secure hidden receipt of the head of frame assembly securement bolts transversely thereacross for securement to an outside frame assembly support arrangement such as a swivel frame, a pedestal stand or an outside frame support. An elongated single frame support may be attached to a second side of the inner elongated bridge member to create an inner wall of a graphic receiving slot. A first elongated innermost first graphic slot flange and an elongated innermost second graphic slot flange are connected to the single flange support to create a further wall of each graphic receiving slot. An elongated (omega shaped in this embodiment) corner bolt receiving slot arrangement is arranged on a first side of the elongated intermediate bridge member, so as to enable adjacent rail members to be boltably secured to one another in the frame assembly. The elongated ("omega" in one embodiment) shaped corner screw/bolt receiving slot arrangement is disposed within the central channel. At least one bore is arranged transversely through the single flange support, the intermediate bridge member and the outer elongated bridge member of one rail member of the frame assembly for adjustable receipt of a securement screw/bolt therethrough, and attachment to a frame assembly support means.

The invention also comprises an elongated rail member for end-wise attachment to a further elongated rail member for the manufacture of a flexible fabric supporting frame assembly, each elongated rail member comprising: an elongated outermost bridging member; an innermost elongated bridging member and an intermediate elongated bridging member each connected along their elongated edges by a first side member and a second side member respectively, wherein an elongated chamber is disposed between the elongated intermediate bridge member and the elongated innermost bridge member to define a hardware-head-enclosing-channel to enable the secure hidden receipt of frame assembly securement bolts transversely thereacross for securement to a frame assembly support arrangement.

The invention also thus comprises a multi-sided frame assembly for removably supporting and displaying a fabric graphic from a first side and a second side thereof, the frame assembly comprising; a plurality of elongated rail members connected at their respective ends to form an array of graphic receiving channels peripherally therearound, wherein each rail member comprises an enclosed central channel, an enclosed hardware-head enclosing-enabled channel and at least one graphic edge bead receiving channel. The at least one graphic bead receiving channel of each of the plurality of rail members preferably has a bead of a graphic snugly received therein, and, wherein each rail member may have at least one graphic edge bead receiving channel on each side thereof, and wherein each graphic bead receiving channel may be disposed transversely across from one another on each rail member, and wherein each graphic bead receiving channel may be disposed immediately inwardly adjacent an outermost elongated surface thereof to define a frame hidden construction and wherein each graphic bead receiving channel may be disposed transversely across from one another immediately adjacent an innermost elongated surface thereof to define a frame exposed construction.

BRIEF DESCRIPTION OF THE DRAWINGS

The objects and advantages of the present invention will become more apparent, when viewed in conjunction with the following drawings, in which.

DETAILED DESCRIPTION OF THE PRESENT INVENTION

Figure 1:
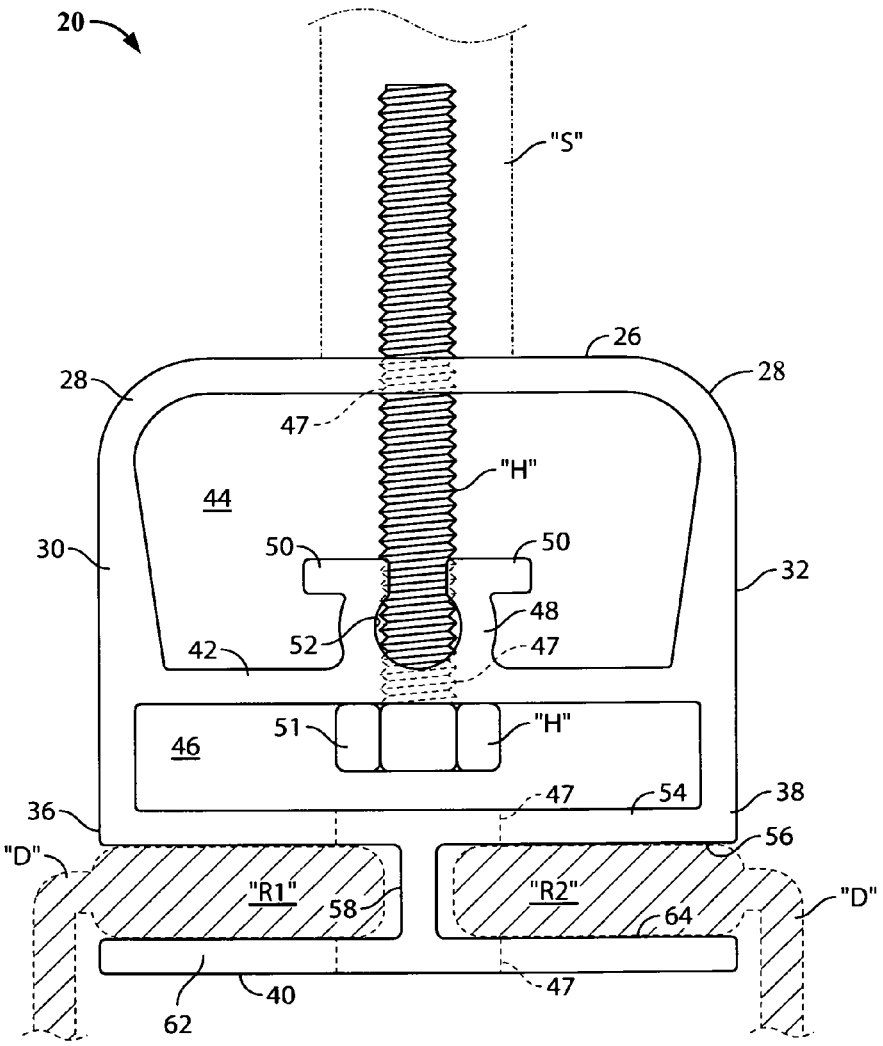
FIG. 1 is an end view of a first or "frame-exposed" embodiment of a rail member constructed according to the principles of the present invention, also showing hardware typically extending therethrough at a longitudinal midpoint thereof to enable attachment to an outside support.
Figure 1A:
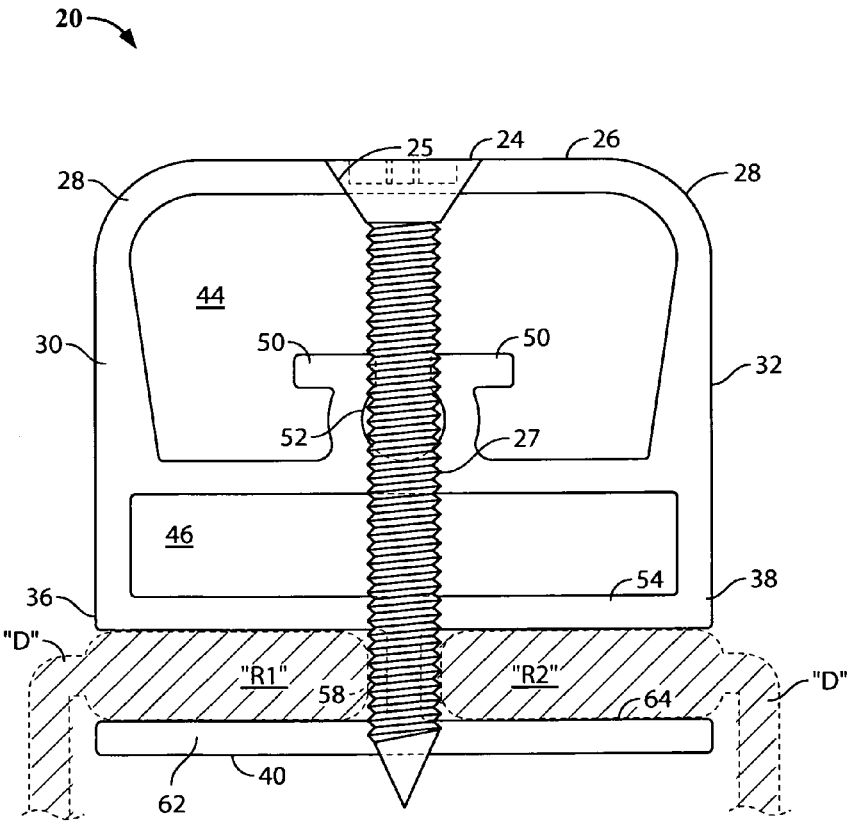
FIG. 1A is an end view similar to FIG. 1 also showing hardware which would typically be adjacent the ends of the rail member to enable threaded securement thereof to a receiving channel of an adjacent rail member.
Figure 3:
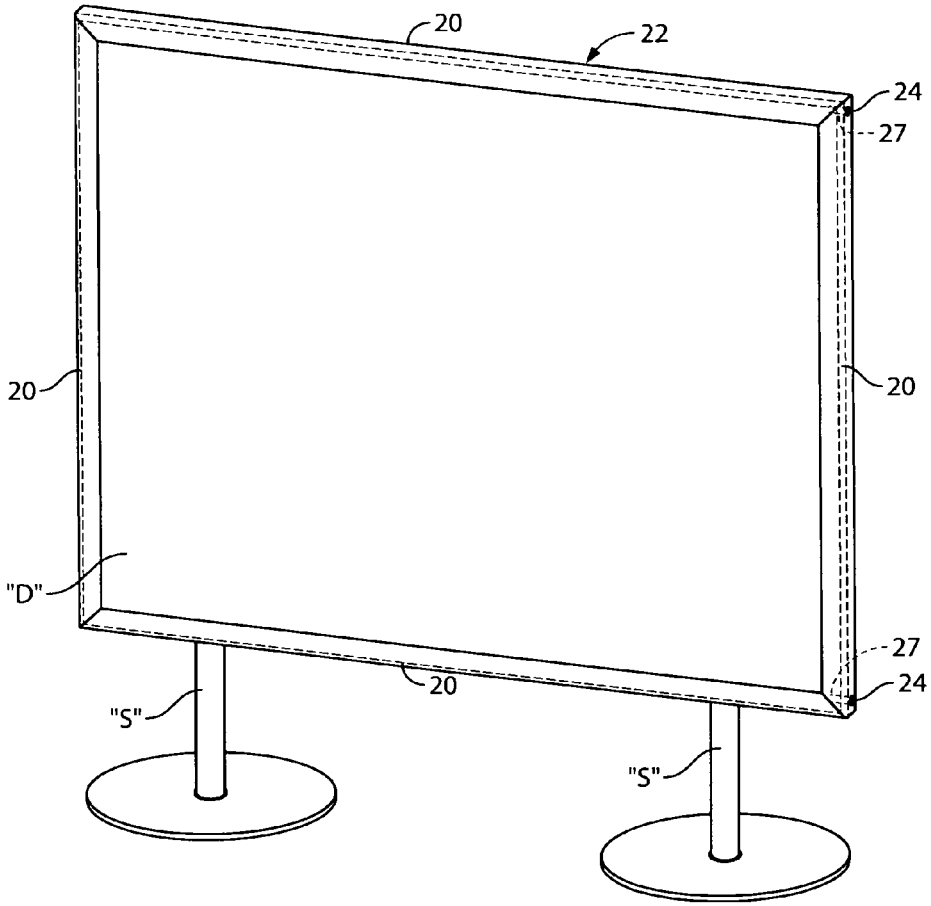
FIG. 3 is a perspective view of a frame assembly constructed according to the principles of the present invention, shown having a plurality of floor supports thereunder.
Figure 4:
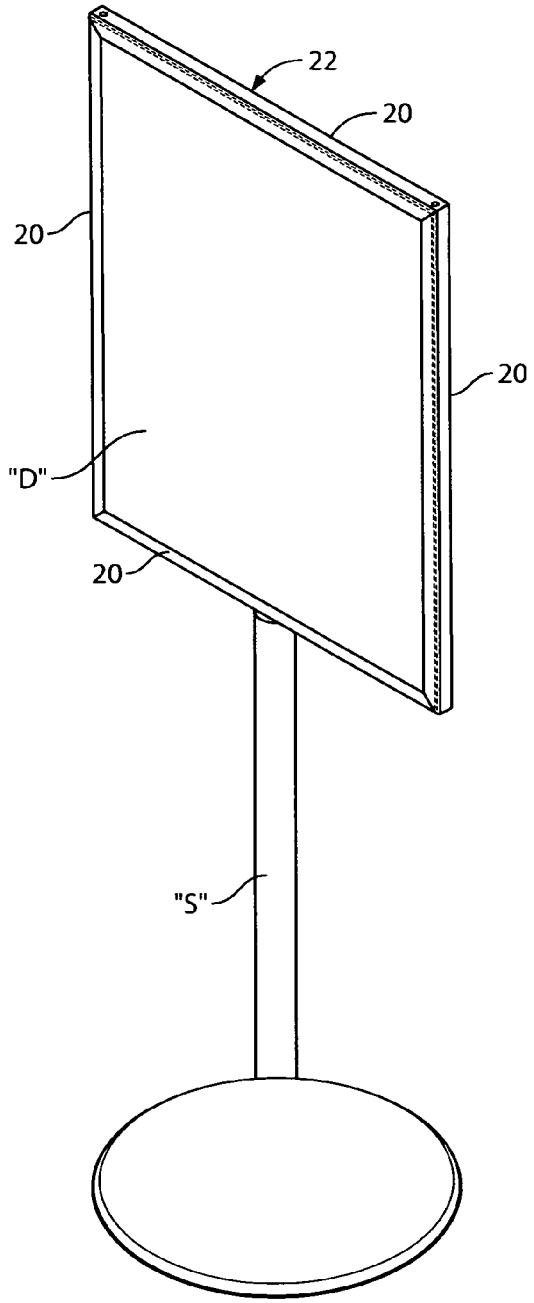
FIG. 4 is a perspective view of a frame assembly constructed according to the principles of the present invention having a single floor support thereunder.

Referring now to the drawings in detail, and more particularly to FIG. 1, there is shown the present invention which comprises, in an end view of one rail member 20 of a multi-rail member frame assembly 22 (shown assembled in FIG. 3), thus consisting of a plurality of those unitary rail members 20 joined at the respective mitered ends (not shown mitered for clarity of viewing) by corner connectors such as L shaped inserts, or by threaded flat headed screws or the like 24, as may be seen in FIG. 1A insertable into a countersunk opening 25 and through a bore 27, shown near the end of a rail member 20 in FIG. 3, the screw 24 being threaded into a receiving channel 52 formed between the projections 48 of its adjacent rail member 20/80, as shown in further inventive embodiments hereinbelow.

In a first preferred embodiment of the present invention as a "frame exposed" graphic display presentation, (where the graphic display "D" leaves most of the sides 30 and 32 of the rail members 20 visible) the frame assembly 22 shown in FIG. 3, comprises a quadrilateral arrangement of elongated extruded rail members, the assembly of which typically requires the use of mitered ends thereon, as shown in FIGS. 3, 4, 5, 6, 7, 8 and 9.

Each rail member 20 in a cross-sectional presentation thereof represented in FIGS. 1 and 1A, is generally of "U" shaped configuration, defined by an intendedly outwardly disposed first or outer elongated "outwardly-facing" member such as a bridging member 26 having elongated, side edge corners 28 which each extend into a first side member 30 and a second (here shown as tapered thickness) side member 32 respectively. The first and second side members 30 and 32 extend to a first L-shaped portion 34 and a second L-shaped portion 36 and 38 respectively, as may be seen in FIGS. 1, 1A and 2.

The first and second L-shaped portions 30 and 32 are connected by an innermost elongated inwardly facing member such as bridge member 40. The first and second side members 30 and 32 are also connected by an intermediate bridge member 42. The intermediate bridge member 42 divides the elongated extruded rail member 20 into a outside-hardware-piercing central channel 44 and an intermediate, attachment hardware-head (51) enclosing/capturing secondary channel 46. Hardware "H" such as a bolt/setscrew or the like, is securable to an outer support arrangement "S", which are shown in FIGS. 3-9, by entering through a bore 47 projecting transversely through a desired (typically longitudinally central) location between the juncture of the first and second graphic slot flanges 62 and 64 (both of which define the innermost bridging member 40), the flange support 58, the intermediate bridge member 42 and finally the outer bridge member 26. The head 51 of the outside-support-engaging hardware "H" remains out of sight and enclosed within the intermediate hardware-head-enclosing enabled channel 46, accessible only through the open bore 47 through the flange support 58 at the first and second flange 62/64 juncture in the inner member 40, as represented in FIG. 1.

Figure 2:
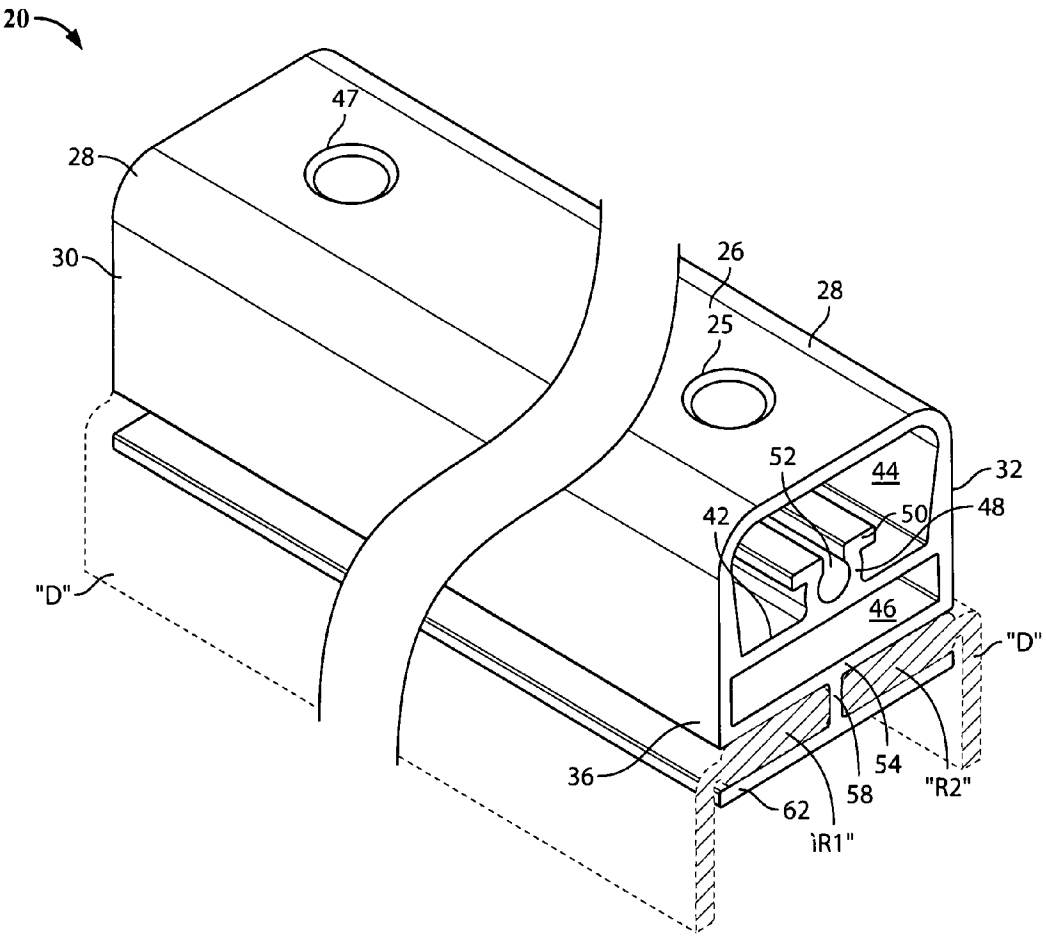
FIG. 2 is a perspective view of the rail member shown in FIG. 1.

The intermediate bridge member 42 has an elongated projection (omega shaped in this embodiment) 48 extending at mid-location thereof interiorly into the central channel 44, as may be seen in FIGS. 1 and 2. The (omega) shaped projection 48 is defined by a pair of parallel, generally "L" shaped flanges 50 with the corner hardware enclosing/capturing securement slot 52 extending longitudinally therebetween.

An inner elongated intermediate bridge member 54, which extends between the first side L-shaped portion 36 and the second L-shaped side portion 38 of the unitary rail 20 has a second or iner facing side 56 extending along and opposite to the secondary channel 46. The elongated single flange support 58 (which divides and separates receiving slots R1 and R2), extends longitudinally down the length of the elongated innermost bridge member 54, as shown in FIGS. 1 and 2. The single flange support 58 has a distal end 60 which is attached, co-extrudedly, to an elongated innermost first graphic receiving slot flange 62 and an elongated innermost second graphic receiving slot flange 64 both of which together defines the innermost bridge member 40.

The elongated space between the elongated innermost first graphic slot flange 62 and second side 56 of the innermost elongated bridge member 54 as well as the space between the elongated innermost second graphics slot flange 64 and the second side 56 of the innermost elongated bridge member 54 respectively, thus define a first, elongated graphic bead slot receiving channel R1 transversely opposed to a second co-extensive, elongated graphic bead slot receiving channel R2 respectively, partially defined by and separated from one another by the single flange support 58. Such graphic displays "D" would extend generally in a plane away from and leave visually exposed, both the first and second side members 30 and 32 towards a central portion of the frame assembly 22, as is represented in FIGS. 1, 1A and 2.

Figure 10:
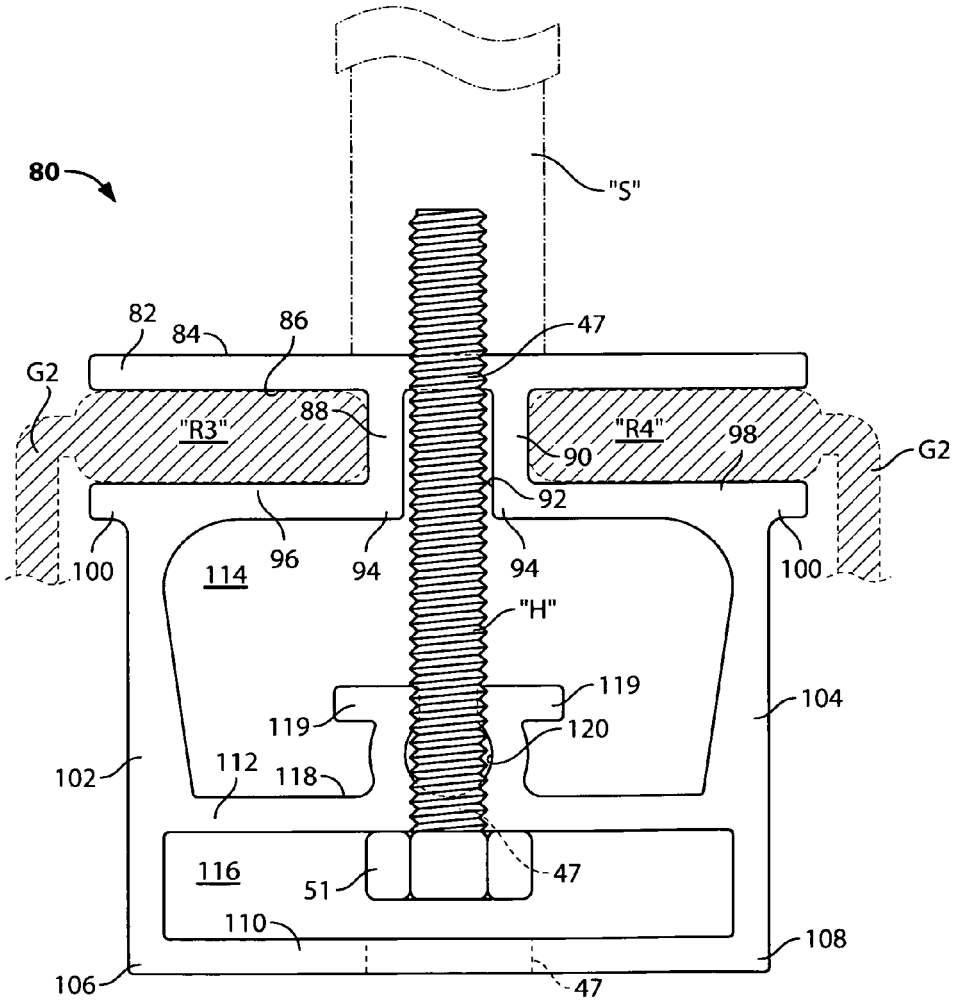
FIG. 10 is an end view of a second or "frame-hidden" embodiment of a rail member constructed according to the principles of the present invention, also showing hardware typically extending therethrough at a longitudinal midpoint thereof to enable attachment to an outside support.
Figure 10A:
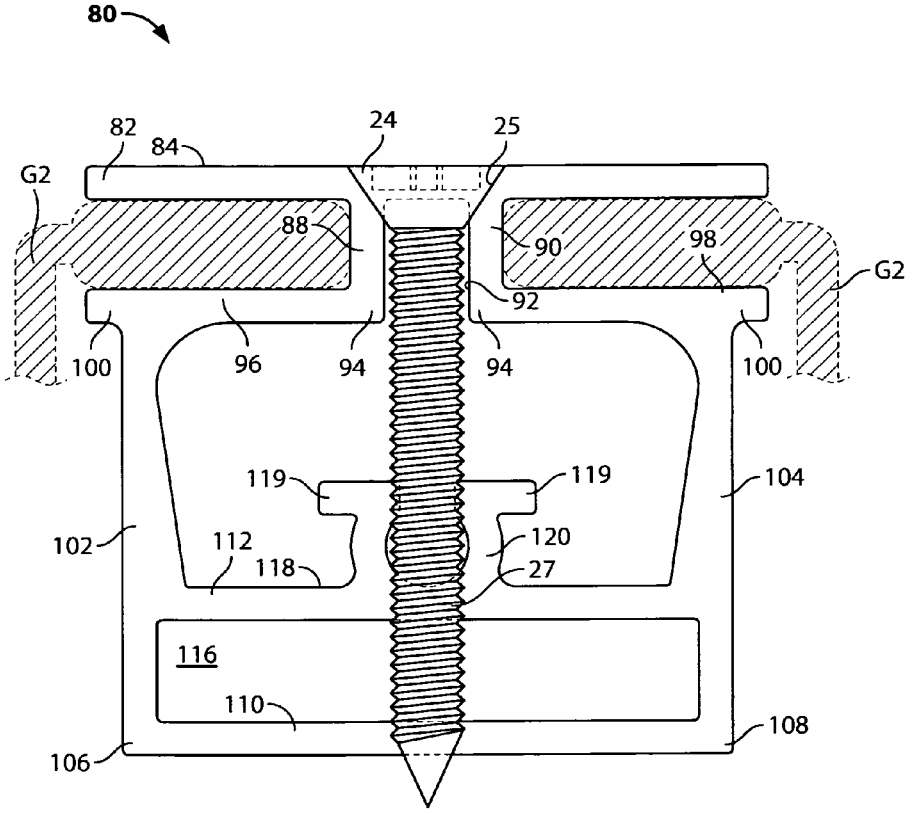
FIG. 10A is an end view similar to FIG. 10, also showing hardware which would typically be adjacent the ends of the rail member to enable threaded securement thereof to a receiving channel of an adjacent rail member.
Figure 11:
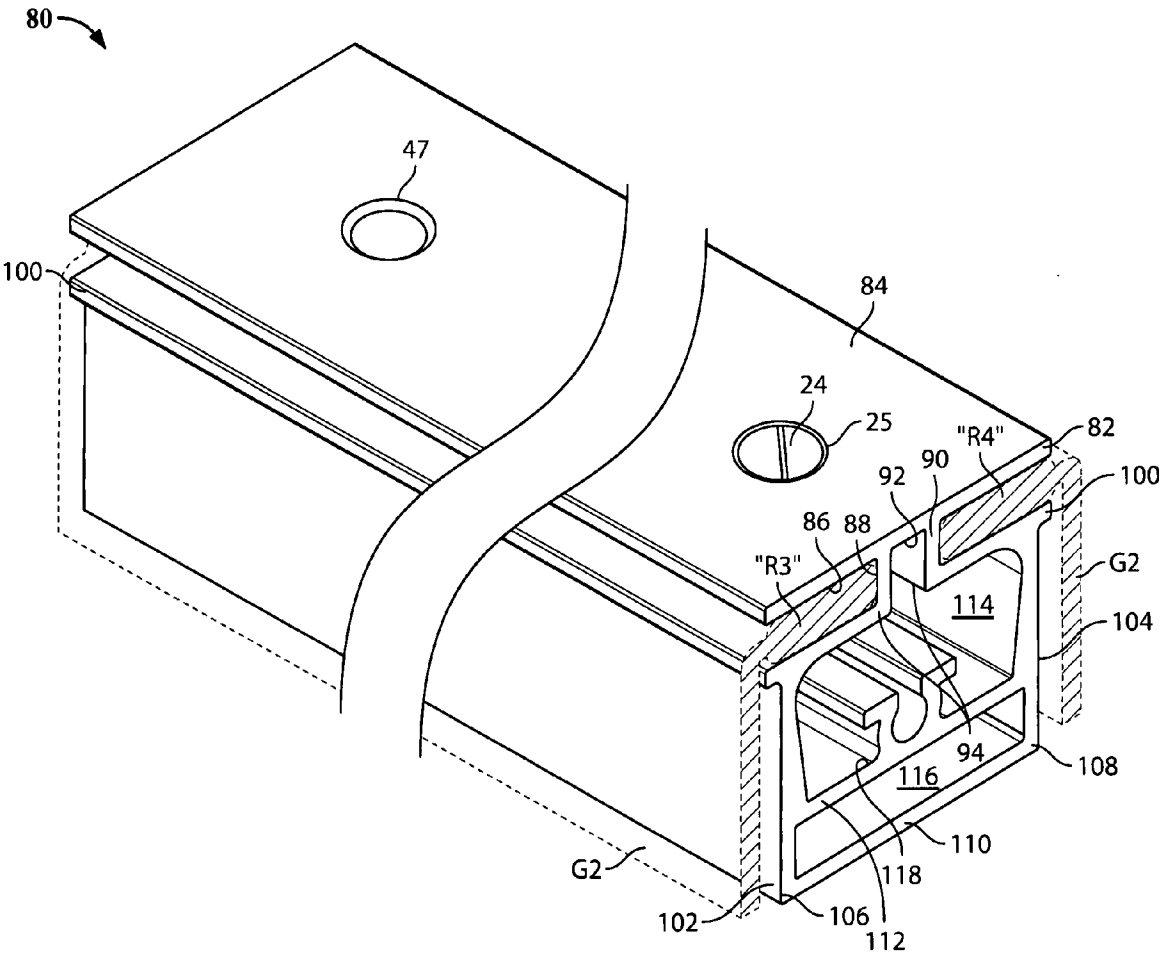
FIG. 11 is a perspective view of the second embodiment of the rail member shown in FIG. 10.
Figure 12:
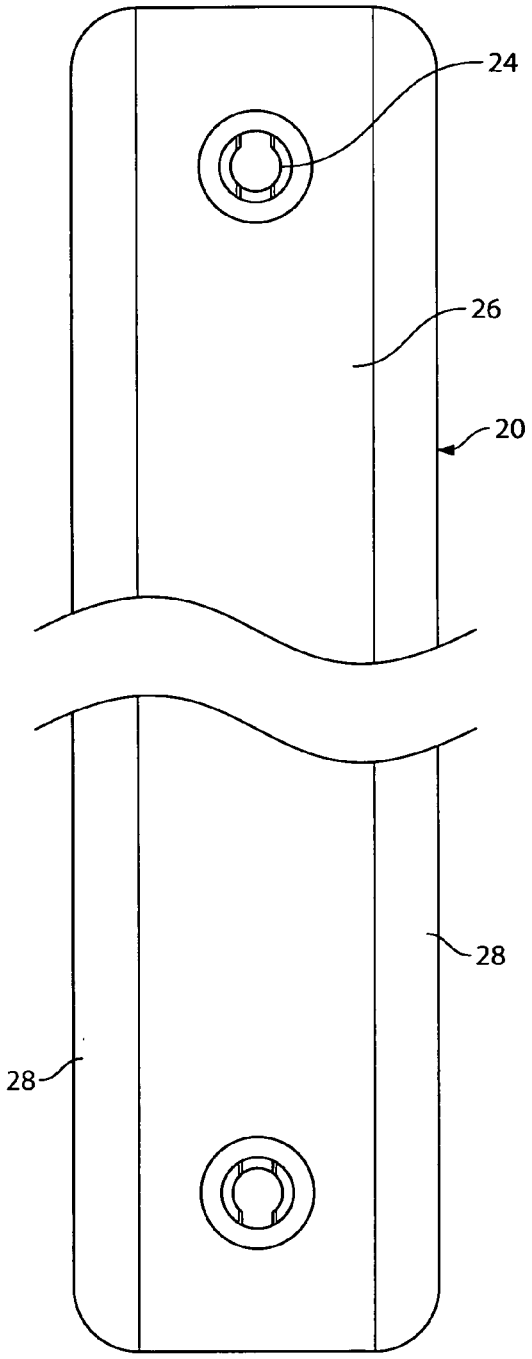
FIG. 12 is a side elevation view of one end of the frame assembly.
Figure 13:
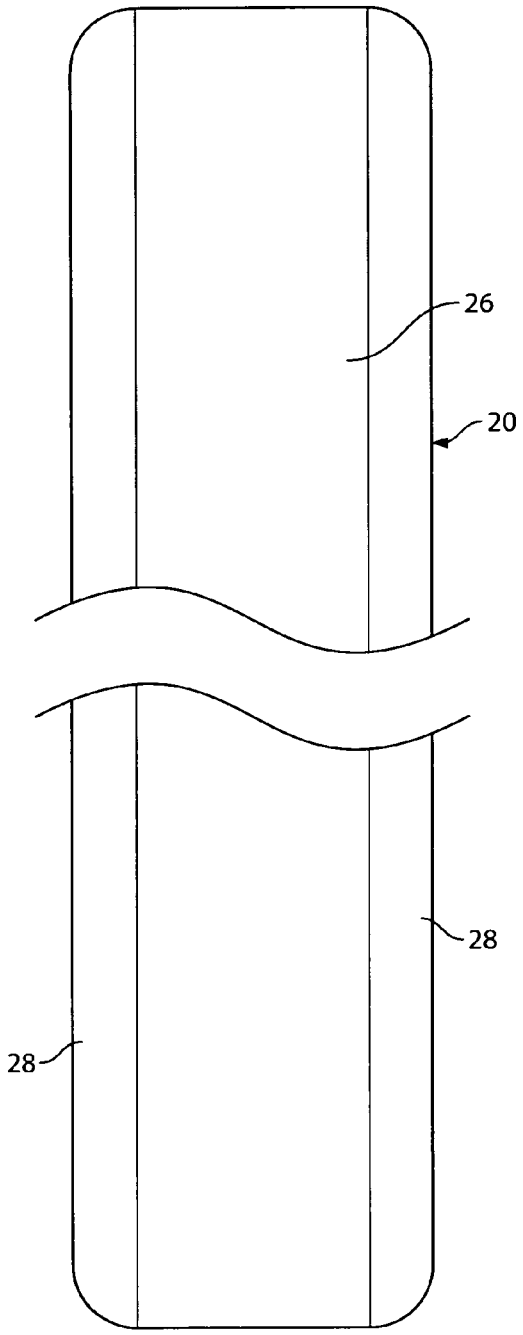
FIG. 13 is an end view of one side of the frame assembly constructed according to the principles of the present invention.

In a second preferred embodiment of the present invention is a "frame hidden" graphic display presentation (wherein most of the sides of the rail members 80 are covered by a displayed graphic G2), as represented in FIGS. 10, 10A and 11, wherein the frame assembly 22 comprises a quadrilateral arrangement of elongated extruded rail members 80, the assembly of which preferably has mitered ends thereon. FIG. 10 represents the hardware "H" which is needed to attach and support a "frame-hidden" frame assembly 22 constructed of four rail members 80 by an outside support "S" such as a stand or the like represented in FIGS. 4 and 5.

Each rail member 80, as represented in FIGS. 10, 10A and 11, comprises an elongated, planar, outer facing outer member 82 having an outer face 84 and an inner surface 86. A first inner wall 88 and a second inner wall 90, parallel to one another, extend longitudinally along the inner surface 86 of the outer facing member 82. The first inner wall 88 and the second inner wall 90 are parallel and spaced apart to define a narrow channel 92, wherein a further embodiment, such channel 92 would be solid therethrough. The first inner wall 88 and the second inner wall 90 have a L-shaped lower end 94, opposed away from one another, as shown in FIGS. 10, 10A and 11, contiguously coextruded with a first inner slot defining wall 96 and a second inner slot defining wall 98, respectively. The first inner slot defining wall 96 and the second inner slot defining wall 98 extend parallel with the outer facing member 82. First inner slot defining wall 96 and the second inner slot defining wall 98 each have an elongated distalmost edge comprising an extended graphic supporting shoulder lip 100. A first side wall member 102 and a second side wall member 104, parallel to one another, extend off of each respective graphic supporting shoulder lip 100 of the first in a slot defining wall 96 and the second inner slot defining wall 98, respectively, each having a lower end with a first side L-shaped portion 106 and a second side L-shaped portion 108, respectively. An innermost elongated bridge member 110 connects the first side L-shaped portion 106 and the second L-shaped portion 108 coextrudedly theretogether, as represented in FIGS. 10 and 11. The wall portions 86, 88, and 96 define the first graphic bead elongated receiving slot or channel R3, and the wall portions 86, 90 and 98 define the second graphic elongated bead receiving channel R4. The channels R3 and R4 are transversely opposed, across from one another, as shown in FIGS. 10 and 10A by the narrow bead-receiving divider channel 92.

An intermediate bridging member 112 shown best in FIGS. 10 and 10A, extends between the first side wall member 102 and the second side wall member 104, along a generally midportion thereof, to devide the rail member 80 into a central channel 114 and an inner hardware-head-enclosing channel 116. The inner channel 116 may be utilized for accommodation via bore openings 47, shown in FIG. 10, to enable access to frame assembly support connective hardware, if needed, recited hereinbelow. The intermediate bridging member 112 has a first side 118 with an elongated pair of projections 119 to define the elongated (conveniently omega-shaped here) corner-securing-member receiving slot 120 arranged longitudinally therealong as recited in the aforementioned embodiment for receiving corner receiving members 24 (preferably flathead screws, best seen in FIG. 10A).

Figure 5:
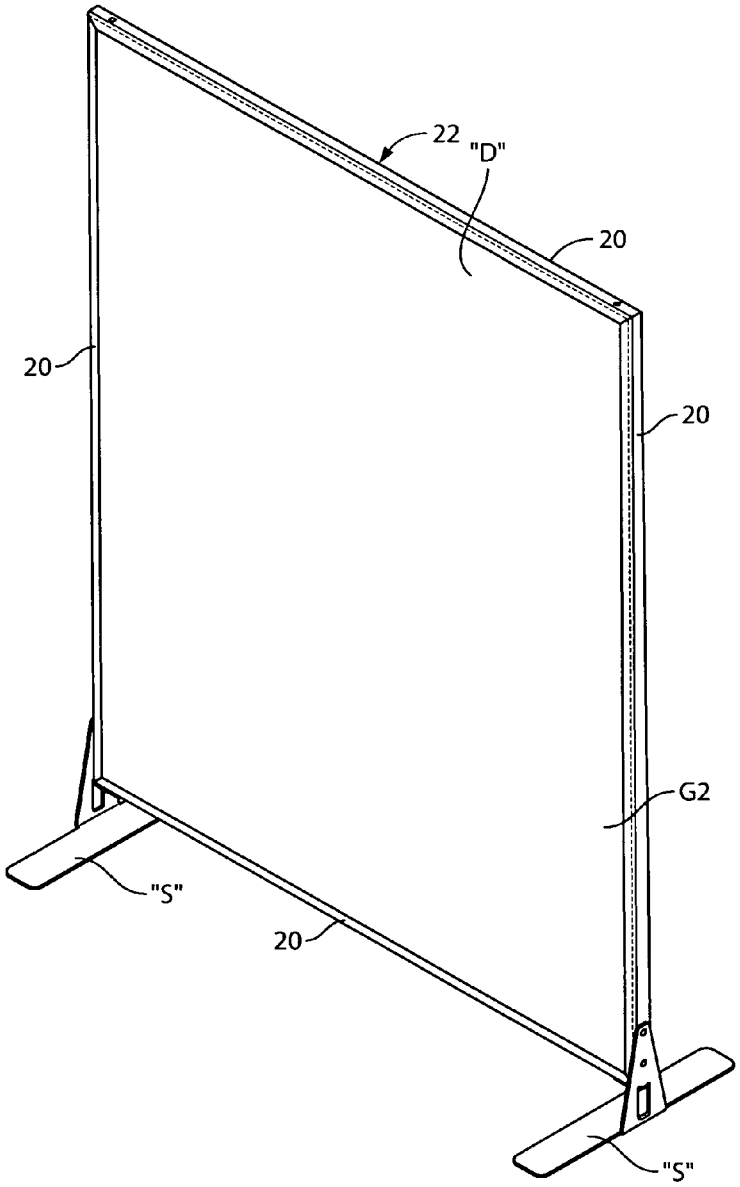
FIG. 5 is a perspective view of a frame assembly constructed according to the principles of the present invention, shown with a couple of base supports thereon.
Figure 6:
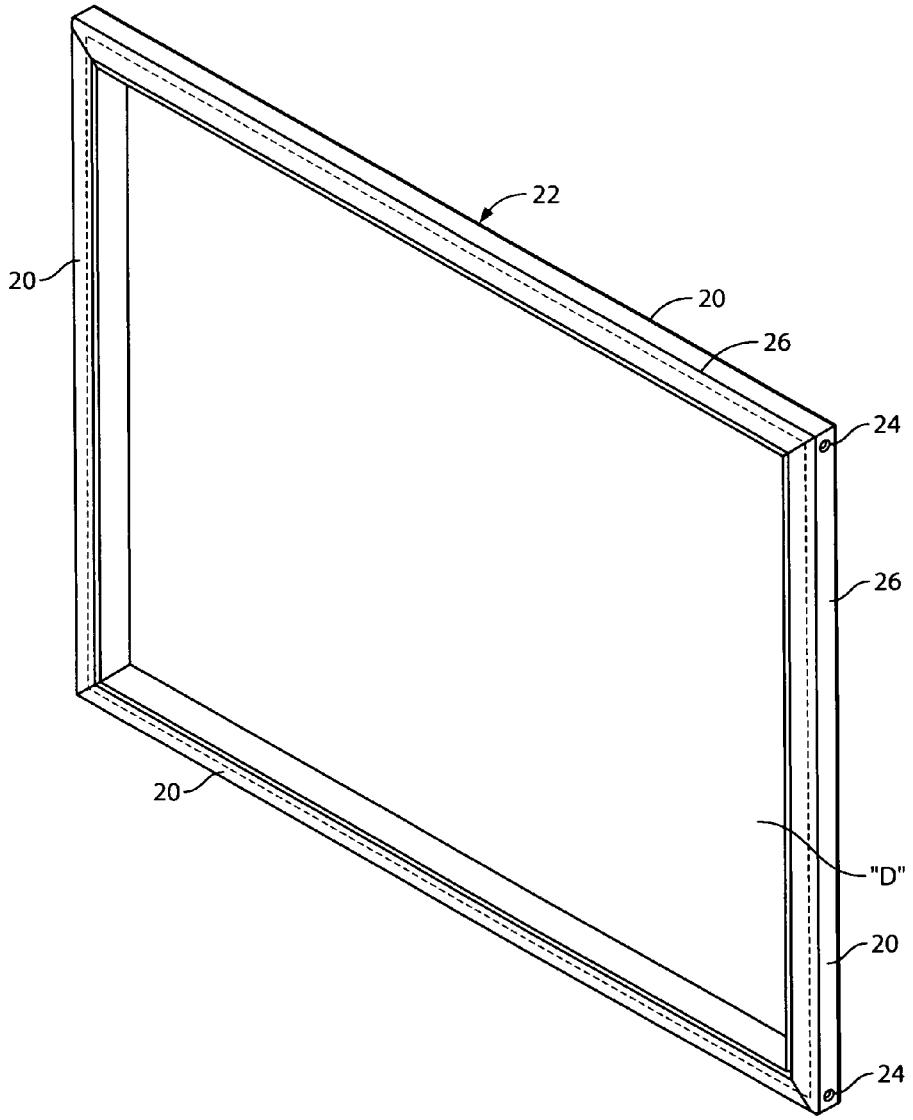
FIG. 6 is a perspective view of a frame assembly constructed according to the principles of the present invention showing securement means at one end of that frame assembly.
Figure 7:
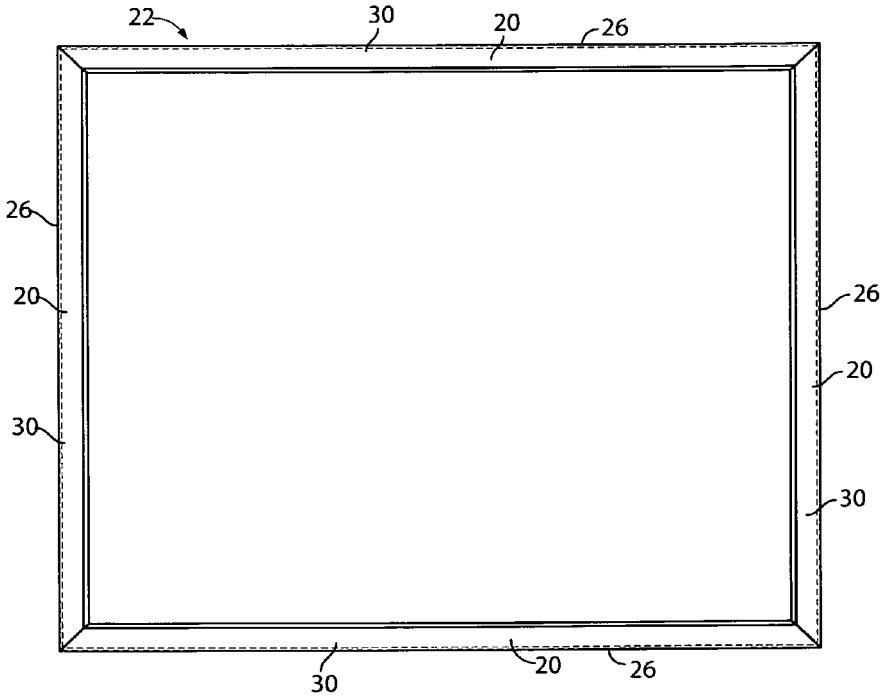
FIG. 7 is a plan view of a frame assembly constructed according to the principles of the present invention.
Figure 8:
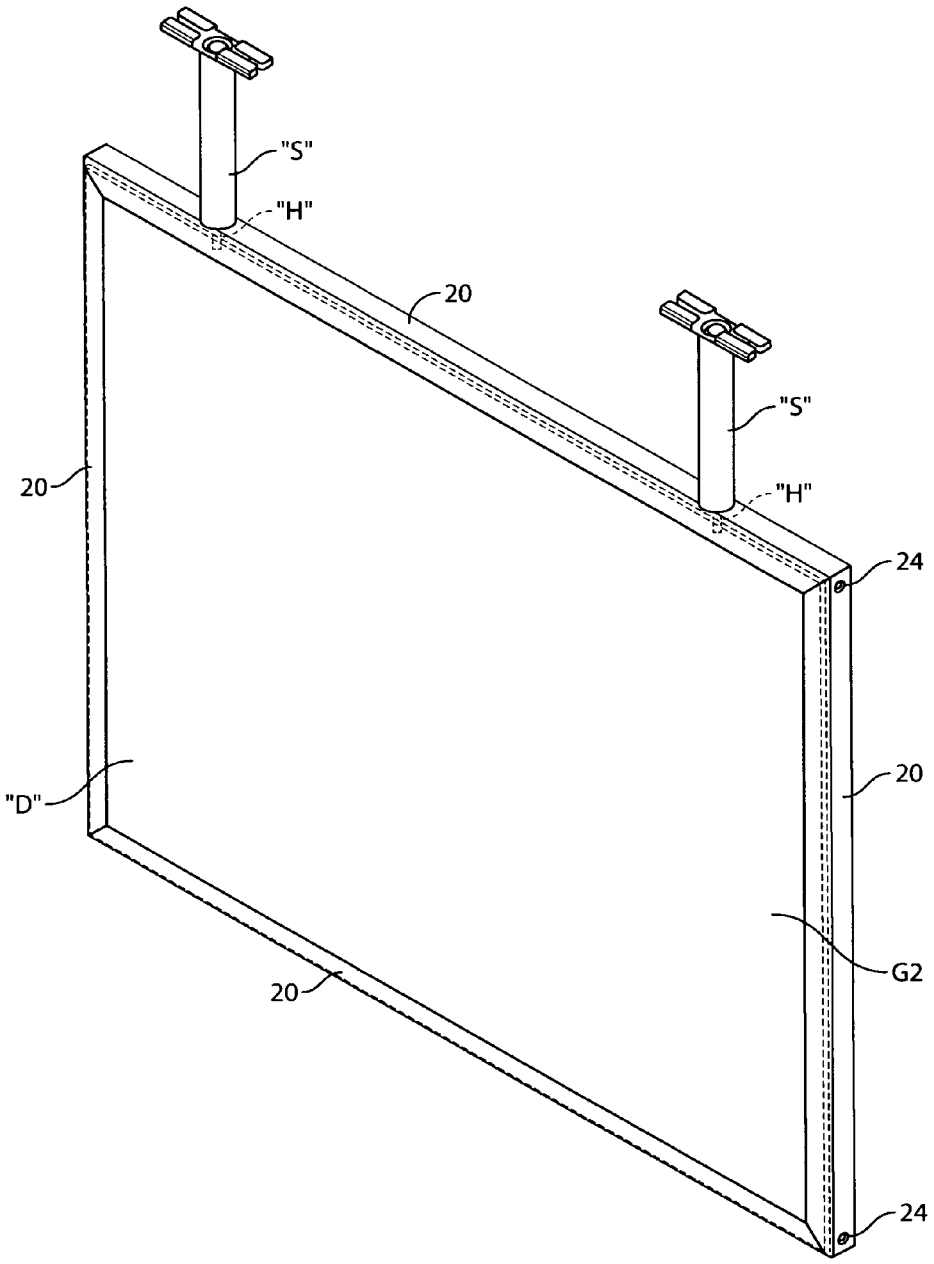
FIG. 8 is a perspective view of a frame assembly constructed according to the principles of the present invention having "outside" overhead support arrangements there attached.
Figure 9:
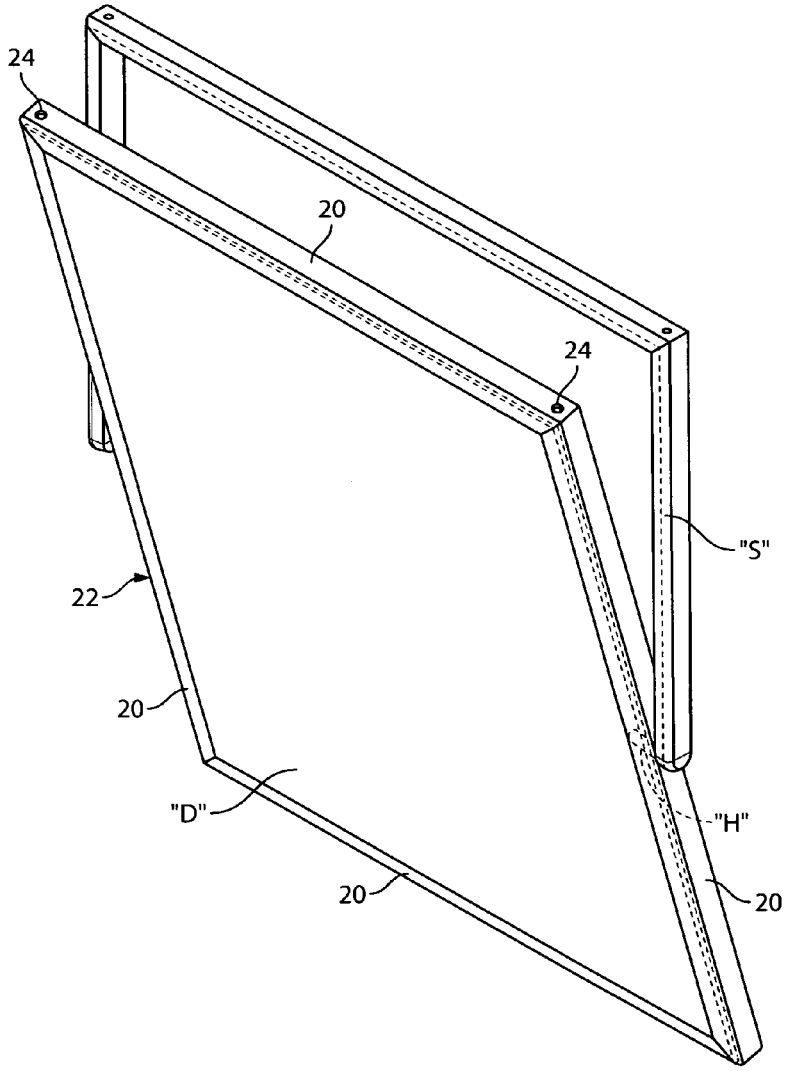
FIG. 9 is a perspective view of a frame assembly swivelably supported within an "outside" swivel frame.

The first inner slot R3 and the second inner slot R4 define elongated opposed, parallel, twin receiving portions for the "tucking in" of the beaded peripheral edge of a flexible graphic sheet G2, and drape over the major portion of their respective rail member 80, as represented in FIGS. 10 and 10A, to present a "frame hidden" construction of the frame assembly, as best represented in FIGS. 5 and 8, wherein the side wall member portions 102 and 104 of each rail member 80 is/are "basically" covered by the graphic display G2 pulled thereinfront, and thus hidden by the graphic(s) G2.

Thus, when a plurality of rail numbers 20 or 80 are joined together by their respective (not shown for clarity of viewing, except ith frame assembly figures) preferably mitered ends, with a securement device 24 either through an outer wall portion of one rail number or through an L-shaped securement arrangement, (not shown for clarity of drawings) with the respective slots provides an aligned graphic bead securing means to fully and securely display a flexible graphic D or G2 therewithin.

We claim:

1. A multi-sided frame assembly for enabling the supporting and displaying of a fabric display from both sides therefrom, the frame assembly comprising:

a plurality of elongated rail members connected at their respective ends by a securement arrangement therebetween, wherein each elongated rail member comprises an elongated outermost bridging member; an innermost elongated bridging member and an intermediate elongated bridging member each connected along their elongated edges by a first side member and a second side member respectively, wherein an elongated chamber is disposed between the elongated intermediate bridge member and the elongated innermost bridge member to define a hardware-enclosable-channel (46/116) to enable the secure hidden receipt of frame assembly outside-securement-bolts ("H") transversely thereacross for securement to an outside frame assembly support arrangement ("S").

2. The frame assembly as recited in claim 1, including an elongated single frame support attached to a second side of the inner elongated bridge member to create an inner wall of a graphic receiving slot.

3. The frame assembly as recited in claim 2, including a first elongated innermost first graphic slot flange and an elongated innermost second graphic slot flange connected to the single flange support to create a further wall of each graphic receiving slot on each side of the rail member to enable a bead of a flexible graphic display to be secured on each side thereof.

4. The frame assembly as recited in claim 3, including an elongated shaped corner bolt receiving slot arrangement arranged on a first side of the elongated bridge member, so as to enable adjacent rail members to be boltably secured to one another in the frame assembly.

5. The frame assembly as recited in claim 4, where in the elongated shaped corner bolt receiving slot arrangement is disposed within the central channel.

6. The frame assembly as recited in claim 5, wherein at least one bore is arranged transversely through the single flange support, the intermediate bridge member and the outer elongated bridge member of one rail member of the frame assembly for adjustable receipt of a securement bolt therethrough, to enable attachment to an outside frame assembly support.

7. An elongated rail member for end-wise attachment to a further elongated rail member for the manufacture of a two-sided flexible fabric supporting frame assembly, each elongated rail member comprising:

an elongated outermost bridging member; an innermost elongated bridging member and an intermediate elongated bridging member each connected along their elongated edges by a first side member and a second side member respectively, wherein an elongated chamber (46/116) is disposed between the elongated intermediate bridge member (42/112) and the elongated innermost bridge member (54/110) to define a hardware-head-enclosable-channel so as to enable the secure hidden receipt of frame assembly securement bolts transversely thereacross to permit the securement of the frame assembly to an outside frame assembly support arrangement.

8. The elongated rail member as recited in claim 7, wherein the outermost bridging member comprises an elongated first graphic slot flange and an elongated second graphic slot flange.

9. The elongated rail member as recited in claim 8, including a first and a second inner walled narrow outer-facing-edge-adjacent channel (92) to enable display of fabric-interference-free graphic (G1/G2) by a frame-hidden frame assembly.

10. The elongated rail member as recited in claim 9, including a graphic fabric engaging slot (R3/R4) adjacent the elongated outermost bridging member at each side thereof to permit a graphic display supported on each side thereof.

11. The elongated rail member as recited in claim 10, including a graphic support shoulder (100) at each graphic engaging slot.

12. A multi-sided frame assembly for enabling the removable support and the displaying of an edge-beaded fabric graphic from the edges of a first side and a second side thereof, the frame assembly comprising;

a plurality of elongated rail members (20/80) connected at their respective ends to form a four-sided array of parallel-disposed transversely adjacent graphic-edge-bead receiving channels (R1/R2), (R3/R4) peripherally therearound for displaying from a channel edge of the rail members, wherein each rail member (20/80) comprises an enclosed central channel (44/114), an enclosed corner-connecting hardware-head-enclosing channel (46/116) to enable interference channel edge-covered display of a flexible graphic display on up to two sides of the frame assembly.

13. The multi-sided frame assembly as recited in claim 12, wherein each rail member has at least one graphic edge bead receiving channel on each side thereof.

14. The multi-sided frame assembly as recited in claim 13, wherein each graphic bead receiving channel is disposed transversely across from one another on each rail member.

15. The multi-sided frame assembly as recited in claim 14, wherein each graphic bead receiving channel is disposed immediately inwardly adjacent an outermost elongated surface thereof to define a frame hidden construction.

16. The multi-sided frame assembly as recited in claim 15, wherein each graphic bead receiving channel is disposed transversely across from one another immediately adjacent an innermost elongated surface thereof to define a frame exposed construction.

17. The multi-sided frame assembly as recited in claim 12, wherein the at least one graphic bead receiving channel of each of the plurality of rail members has a bead of a graphic snugly received therein.

* * * * *